US006231683B1

(12) United States Patent
Rushton et al.

(10) Patent No.: US 6,231,683 B1
(45) Date of Patent: May 15, 2001

(54) METHOD FOR CLEANING RADIOACTIVELY CONTAMINATED MATERIAL

(75) Inventors: Alan Rushton; James Clark Armit, both of Preston (GB)

(73) Assignee: British Nuclear Fuels plc (GB)

( * ) Notice: Subject to any disclaimer, the term of this patent is extended or adjusted under 35 U.S.C. 154(b) by 0 days.

(21) Appl. No.: 09/423,081

(22) PCT Filed: Apr. 24, 1998

(86) PCT No.: PCT/GB98/01212

§ 371 Date: Nov. 2, 1999

§ 102(e) Date: Nov. 2, 1999

(87) PCT Pub. No.: WO98/53462

PCT Pub. Date: Nov. 26, 1998

(30) Foreign Application Priority Data

May 16, 1997 (GB) ..... 9709882

(51) Int. Cl.[7] ..... B08B 3/00

(52) U.S. Cl. ..... 134/28; 134/11; 134/26; 134/28; 134/31; 134/32; 134/33; 134/34; 134/36; 134/37; 423/3; 423/4; 423/20; 976/DIG. 391; 976/DIG. 392

(58) Field of Search ..... 134/11, 26, 28, 134/31–33, 34, 36, 37; 423/3, 4, 20; 976/DIG. 391, DIG. 392

(56) References Cited

U.S. PATENT DOCUMENTS

| | | | | |
|---|---|---|---|---|
| 3,673,086 | * | 6/1972 | Drobnik | 210/59 |
| 4,217,192 | * | 8/1980 | Lerch et al. | 204/149 |
| 4,349,465 | * | 9/1982 | Krug et al. | 252/626 |
| 4,548,790 | * | 10/1985 | Horwitz et al. | 423/9 |
| 4,690,782 | * | 9/1987 | Lemmens | 252/626 |
| 4,874,485 | * | 10/1989 | Steele | 204/130 |
| 4,902,351 | * | 2/1990 | Kunze et al. | 134/3 |
| 5,322,644 | * | 6/1994 | Dunn et al. | 252/626 |
| 5,573,738 | * | 11/1996 | Ma et al. | 423/20 |
| 5,640,703 | * | 6/1997 | Brierley et al. | 588/1 |
| 5,852,786 | * | 12/1998 | Bradbury et al. | 588/1 |

FOREIGN PATENT DOCUMENTS

| | | | |
|---|---|---|---|
| 2038885 | * | 7/1980 | (GB) . |
| 2 112 199 | | 7/1983 | (GB) . |
| 2195491 | * | 4/1988 | (GB) . |
| 61-275132 | | 12/1986 | (JP) . |
| 2-279508 | | 11/1990 | (JP) . |
| WO 95 16997 | | 6/1995 | (WO) . |
| WO 97 28539 | | 8/1997 | (WO) . |
| WO 98/53462 | * | 11/1998 | (WO) . |

OTHER PUBLICATIONS

European Patent Office Search Report for PCT/GB98/01212 pp. 1–9, Mar. 1999.*

GB Search Report for PCT/GB98/01212 pp. 1–3, Aug. 1998.*

* cited by examiner

*Primary Examiner*—S. Carrillo

(74) *Attorney, Agent, or Firm*—Beyer Weaver & Thomas, LLP.

(57) ABSTRACT

Radioactively contaminated material is cleaned by contacting the material with a decontaminating liquid comprising an aqueous solution of nitric acid containing an NOx generating agent. The NOx generating agent may be a nitrite, for example, sodium nitrite, or a ferrous metal. The material to be cleaned may comprise a plastics material contaminated with uranium or other actinides. Cleaning is effected by placing the material in a rotatable, apertured vessel in which the material is subjected to a leaching cycle by contact with the decontaminating liquid and then a washing cycle in which the material is contacted with a washing liquid.

15 Claims, 2 Drawing Sheets

METHOD FOR CLEANING RADIOACTIVELY CONTAMINATED MATERIAL

FIELD OF THE INVENTION

The present invention relates to the cleaning of radioactively contaminated material and, more particularly to the cleaning of radioactively contaminated plastics material.

BACKGROUND OF THE INVENTION

Before consignment of radioactively contaminated material to a waste disposal site, for example, a waste landfill site, it must be ensured that the contamination of the material is below the specified disposal limits of the site. It is therefore often necessary to treat the contaminated materials before disposal in order to ensure that the contamination levels are within the disposal limits.

Products, for example gloves and sheets, made of plastics material are widely used in the processing and handling of radioactive material. Difficulties have been experienced in cleaning such material sufficiently to enable it to be disposed of safely.

Attempts to clean contaminated plastics material by simply subjecting the material to a nitric acid leaching operation, followed by at least one washing cycle have proved to be unsatisfactory. It was found that the material had not been cleaned sufficiently to enable safe disposal.

A known process for cleaning contaminated waste plastics material is described in International Publication No. 95/16997. This process comprises washing the material in water which contains a strong base, such as soda or potash in aqueous solution. Optionally, a wetting agent, preferably non-foaming, may also be added to the water. During the washing operation a saponification reaction occurs so that the material is subjected to a selective chemical treatment whereby certain surface agents, for example, plasticisers, which contain most of the contaminants are attacked. The washed material is then rinsed in water.

A disadvantage of this process is that the contaminants, such as uranic substances, are not rendered soluble and this presents certain difficulties in their recovery. Recovery must be effected by a solid-liquid separation process, such as filtration, followed by either direct leaching of the uranic substances from the filter, or by physical removal of the solids from the filter and then leaching the uranic substances from the removed solids.

It is an object of the present invention to provide a method of cleaning radioactively contaminated plastics material which is efficient and enables the treated material to be disposed of safely.

SUMMARY OF THE INVENTION

According to the present invention there is provided a method of cleaning plastics material contaminated with radioactive substances comprises the step of contacting the plastics material with a decontaminating liquid comprising an aqueous solution of nitric acid which contains a NOx generating agent.

Preferably the NOx generating agent comprises a nitrite.

Advantageously, the NOx generating agent comprises sodium nitrite.

Alternatively, the NOx generating agent may comprise a ferrous metal.

Preferably the method includes the step of agitating the decontaminating liquid.

The method may include the further step of washing the plastics material following contact thereof with the decontaminating liquid.

The method may comprise the steps of placing the contaminated plastics material in a rotatable vessel having one or more apertures, subjecting the material to a leaching cycle comprising supplying the decontaminating liquid to the inside of the vessel, and rotating said vessel whereby said decontaminating liquid is agitated and mixed with the contaminated material, terminating the rotation of the vessel and discharging the decontaminating liquid therefrom.

The method may further comprise subjecting the material to a washing cycle comprising supplying a washing liquid to the inside of the vessel, rotating said vessel to enable the washing liquid to mix with the material, terminating the rotation of the vessel and then discharging the washing material therefrom.

Preferably the material is subjected to at least one further washing cycle.

The material may be subjected to three washing cycles.

Suitably the contaminated material may be held in a container having one or more perforations.

The decontaminating liquid may have a nitric acid molar concentration having a value within a range of 3M to 5M, the preferred value being 4M.

The material to be cleaned may be contaminated with uranic substances.

An advantage of the method according to the present invention is that it is compatible with processes used in the nuclear industry for the recovery of uranium and for its reincorporation in the uranium fuel cycle.

BRIEF DESCRIPTION OF THE DRAWINGS

Embodiments of the invention will now be described, by way of example, with reference to the accompanying drawings, in which.

DETAILED DESCRIPTION OF THE INVENTION

During decontamination trials for cleaning plastics material contaminated with uranic substances using an aqueous nitric acid solution, it was found that there was a reaction between a ferrous metal component of the apparatus and the nitric acid which had a beneficial effect in the cleaning operation. This reaction between the ferrous metal, specifically, mild steel, and the nitric acid produces both ferric nitrate and nitrogen oxide (NOx) gases within the nitric acid. Laboratory tests showed that the presence of ferric nitrate in the nitric acid had no effect on the ability of the acid to clean the plastics material. However, the addition of iron filings to the acid resulted in an almost immediate effect on the contaminated plastics material submerged in the nitric acid. Within seconds the material was totally clean with no evidence of any discoloration. Further tests, where the NOx gas from the iron/nitric acid reaction was bubbled into the nitric acid showed that it was the presence of the NOx gas which was an important factor in the successful cleaning of the material.

It will be appreciated that, although the use of iron as an additive to the process has beneficial cleaning results, its presence may cause problems in the subsequent processing of the recovered uranium. A NOx generating additive which would be acceptable at the downstream processing stage is a suitable nitrite, such as sodium nitrite.

An investigation to discover the effect of sodium nitrite on the time required to decontaminate plastics material was carried out as follows:

EXAMPLE

Figure 1:
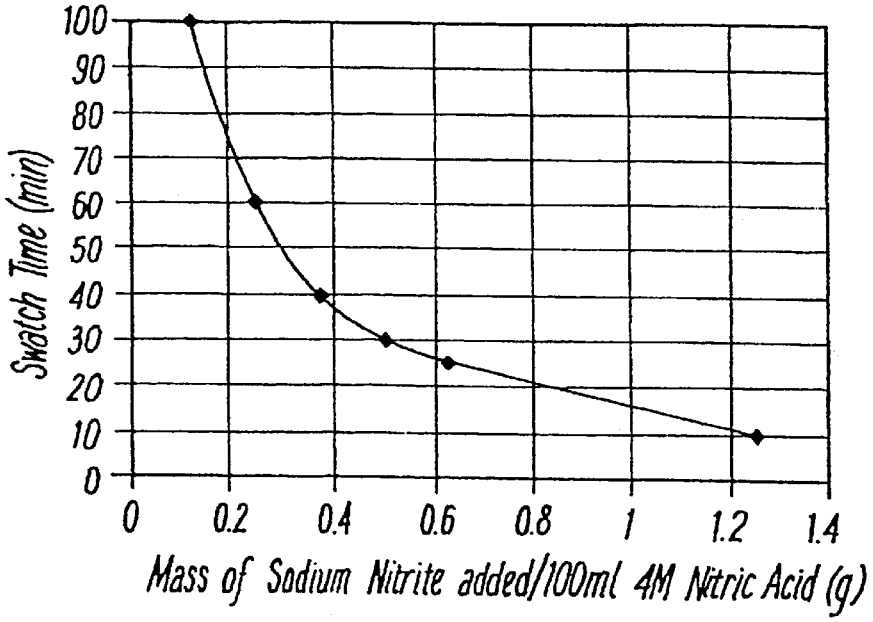
FIG. 1 is a graph showing the effect of sodium nitrite addition on the sample cleaning time.

Plastics material contaminated with approximately 2.5 to 3.5% w/w of uranium dioxide was shredded using a heavy duty office paper shredder. Different masses of sodium nitrite were added to batches of an aqueous solution of 4M nitric acid in which a small swatch, or sample, of approximately 0.2 grams material was submerged. The time taken for the swatch to become visibly clean in the unstirred solution was noted. The results of the tests are shown graphically in FIG. 1 in which the swatch time in minutes is plotted against the mass, in grams, of sodium nitrite added per 100 ml of 4M nitric acid.

Swatch time represents the time taken for the sample of plastics material to be rendered clean. Since it was recognised that the inherent instability of the nitrite in an acid medium, the use of the terms nitrite concentration would be meaningless, hence the sodium nitrite addition is expressed as in terms of mass added per 100 ml of 4M nitric acid.

In one embodiment of the invention the plastics material to be cleaned is placed in a vessel containing a decontaminating liquid comprising an aqueous nitric acid solution to which sodium nitrite has been added. The vessel is equipped with a suitable agitator or stirrer which is operated to agitate the solution. The sodium nitrite reacts with the nitric acid solution to generate NOx gases in the solution which is effective to clean the plastics material.

Figure 2:
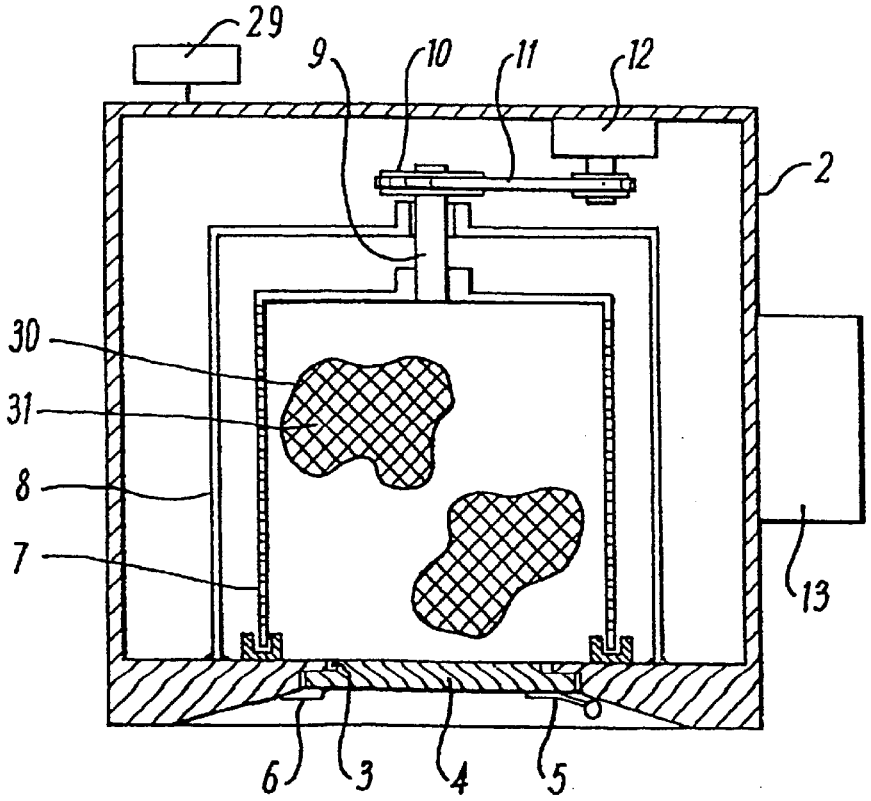
FIG. 2 is a diagrammatic cross-sectional plan view of an apparatus for cleaning radioactively contaminated plastics material.
Figure 3:
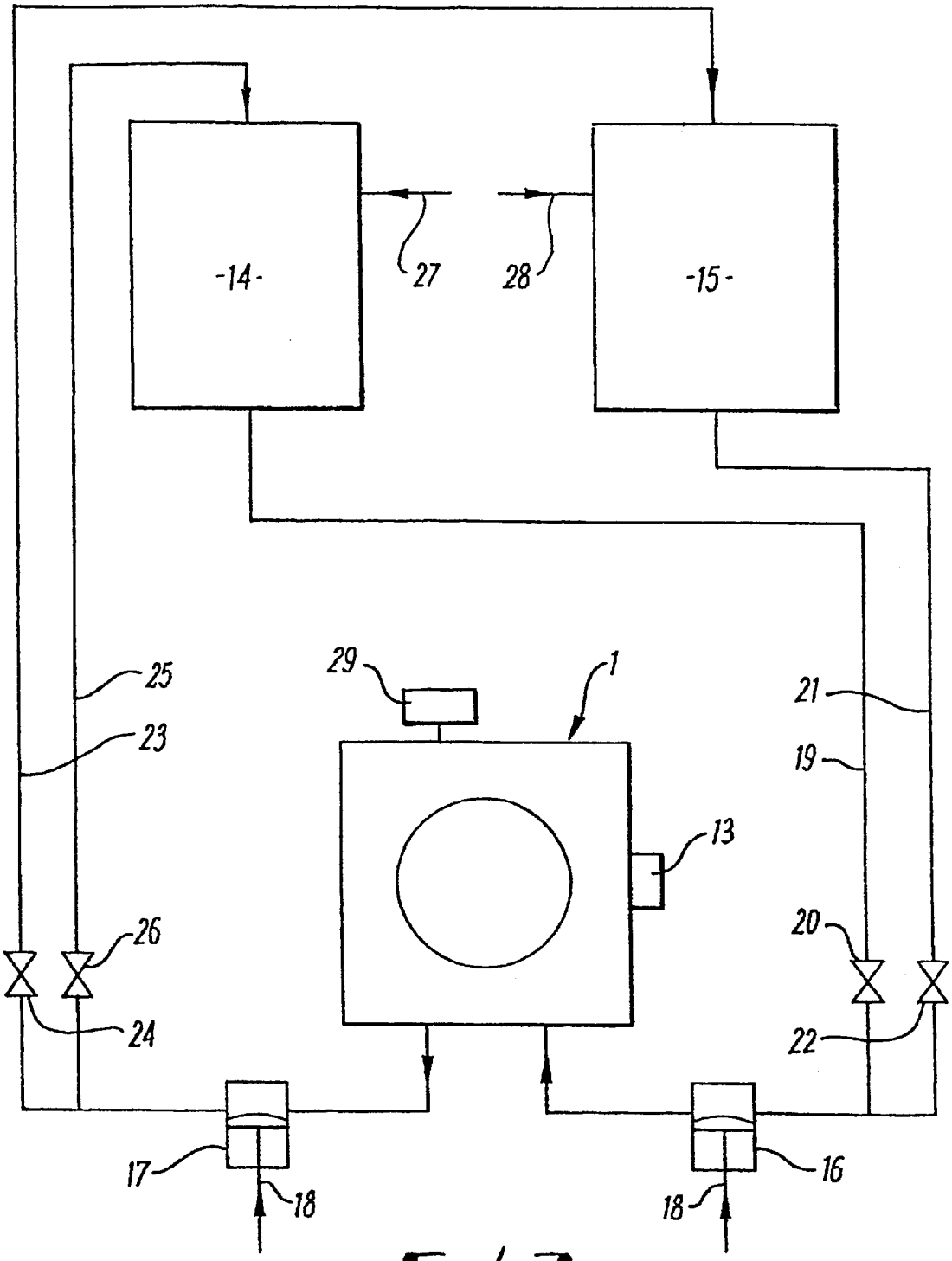
FIG. 3 is a schematic layout of a cleaning apparatus incorporating the apparatus as shown in FIG. 2.

A machine and associated equipment suitable for cleaning contaminated plastics material on a commercial scale is shown diagrammatically in FIGS. 2 and 3, to which reference is now made. The machine comprises a housing 2 having an access opening 3 normally closed by a door 4 which is pivotably mounted at 5 and has a lockable fastening device 6. Seals are provided to ensure that the door 4 is watertight when closed. Interlocks ensure that the door cannot be opened when the machine 1 is in operation. Inside the housing 2 is a cylindrical vessel, preferably a drum 7, having a cylindrical wall perforated by a plurality of holes and arranged for rotation about a horizontal axis within a stationary cylindrical casing 8. Preferably, the drum 7 and the casing 8 are made from stainless steel. The drum 7 has an open end adjacent to the door 4 and is fixedly mounted on a shaft 9 which extends rearwardly through the outer casing 8. A driven pulley 10, mounted on the end of the shaft 9, is rotated by a driving belt 11. Movement of the driving belt 11, and hence rotation of the drum 7, is derived from a drive assembly 12 which may comprise an electric motor and gearbox having a variable speed output. It will be appreciated that other types of variable speed driving arrangements for the drum could be used. A radiation measuring instrument 13, for example, a gamma radiation monitor, may be fitted to the outside of the housing 2.

A schematic layout of a simplified pipework system is shown in FIG. 2 in which the cleaning machine 1 is connected to a tank 14 containing an aqueous nitric acid solution, and a tank 15 containing a washing liquid, preferably water. Suitably, the molar concentration of the nitric acid may be within the range of 3M to 5M, the preferred value being 4M. The machine 1 is equipped with a supply pump 16 and a discharge pump 17. Each of the pumps 16, 17 is preferably of the type comprising a stainless steel, double-diaphragm pump operated by compressed air supplied through lines 18. The supply pump 16 is connected by a pipe 19, provided with a valve 20, to the nitric acid tank 14 and by a pipe 21, equipped with a valve 22, to the water tank 15. Similarly, the discharge pump 17 is connected by a pipe 23, provided with a valve 24, to the nitric acid tank 14 and to the water tank 15 by a pipe 25 having a valve 26. Nitric acid can be supplied to the tank 14 through a pipe 27 and water can be supplied to the tank 15 through a pipe 28. A dispenser 29 is provided for supplying a suitable NOx generating agent, preferably sodium nitrite to the interior of the machine.

In use, the door 4 is opened and the permeable bag 30 containing shredded, contaminated plastics material 31 is inserted through the access opening 4 into the drum 7. Several bags 30 may be treated simultaneously. The door 4 is then closed and it is ensured that the valve 20 is open and that the valves 22, 24 and 26 are closed. A leaching cycle is then initiated by supplying compressed air through the line 18 to the diaphragm pump 16 which operates to pump the nitric acid from the tank 14 through the pipe 20 into the machine 1. The nitric acid is directed into the casing 8 and passes through the perforated wall of the drum 7. Sodium nitrite is introduced from the powder dispenser 29 into the drum 7 of the machine 1. Alternatively, the sodium nitrite can be held in a perforated container which is placed directly into the drum 7 when inserting the bags 30. Typically, the amount of sodium nitrite used is 1000 g for a 10 kg load of plastics material.

The sodium nitrite functions to generate NOx gases in the nitric acid to form a decontaminating liquid. When there is sufficient decontaminating liquid in the machine 1, the drive assembly 12 is operated to cause rotation of the drum 7 at, say 30 rpm. The permeability of the bag 30 allows the decontaminating liquid to act on the plastics material 31, but will prevent the material from blocking the apertures in the drum 7. Rotation of the drum 7 agitates the leaching liquid and promotes intimate mixing of the decontaminating liquid and the plastics material.

Evidently, the chemical process which effects the cleaning of the plastics material is extremely complex. However, it is believed that the NOx gases attack the material surrounding the uranic substances so that these substances are dislodged and released into the leaching liquid. It is apparent that the rate of decontamination is determined by the initial conditions within the washing machine and not by the instantaneous conditions during the leaching process. During the first few moments of the leaching process, it is possible that the plastics material adsorbs the 'active species' which carry out the process of decontamination. The amount of 'species' adsorbed is a function only of the initial conditions within the washing machine.

If desired, the drum 7 may be rotated for a period in the opposite direction, or in successive clockwise and anticlockwise directions, to enhance the mixing of the leaching liquid with the plastics material. After a period of time, say 15–90 minutes, rotation of the drum 7 is stopped and the pump 17 is operated to pump the decontaminating liquid from the machine 1 to the tank 14 through the pipe 25 and the valve 26, which had been opened previously. Optionally, the drum 7 may then be rotated at a high speed, for example at 400 rpm to subject the material to a spin-drying operation by ejecting further decontaminating liquid from the material, the ejected decontaminating liquid then being pumped to the tank 14. A washing cycle is then started by operating the pump 16 with the valve 20 closed and the valve 22 open. Water is thus delivered from the tank 15 through the pipe 21 to the machine 1. By operation of the drive assembly 12 the drum is rotated at, say 30 rpm so that the water mixes intimately with the plastics material 31 and washes out the dissolved uranium substances which have remained in the medium following the leaching cycle. After a period of time, typically 10 to 15 minutes, rotation of the drum 7 is stopped and, with the valve 24 open and the valve 26 closed, the pump 17 is operated to return the water to the tank 15 through the pipe 23. If required, the washing cycle may be repeated. We have found, in practice, that three washing cycles produces satisfactory results.

For a nominal load of contaminated plastics material weighing 10 kg and using 1000 kg sodium nitrate a typical acid leaching cycle has a duration of 60 minutes, followed by three water washing cycles, each of 10 minutes duration.

The drum 7 may then be rotated at a high speed, typically 400 rpm, so as to subject the material 31 to a spin-drying process whereby excess moisture is ejected from the medium. Preferably the drum 7 is rotated at a speed sufficient to subject the material 31 to a centrifugal force in the region of 150 g. Following the spin-drying operation the bag 30 containing the dried, treated and cleaned material 31 can be removed from the machine 1.

The radioactivity of the contents of the machine 1 can be measured by the gamma monitor 13. Before removal of the bags 30 from the machine the gamma monitor 13 can be used to check whether the treated filter medium has been cleaned sufficiently to permit safe disposal. If desired, a separate monitoring station can be provided for checking the contamination level of the treated material. It has been found that decontamination factors in excess of 100 can be achieved.

In practice, the operating sequence and duration of the operation of the pumps, valves and drive means are carried out automatically in accordance with a predetermined programme. Variations in the cycle times can be effected by modifying the programme.

What is claimed is:

1. A method of cleaning a plastics material contaminated with a radioactive substance comprising:

providing a decontaminating liquid comprising:

an aqueous solution of nitric acid, and a NOx generating agent selected from the group consisting of sodium nitrite and ferrous metal;

generating NOx gases in the decontaminating liquid from the reaction of the aqueous solution of nitric acid with the NOx generating agent; and contacting the plastics material contaminated with the radioactive substance with the decontaminating liquid such that the NOx gases generated in the decontaminating liquid remove at least a portion of the radioactive substance from the plastics material.

2. The method according to claim 1, wherein the decontaminating liquid has a nitric acid molar concentration having a value within a range of 3M to 5M.

3. The method according to claim 1, further comprising agitating the decontaminating liquid.

4. The method according to claim 1, wherein the radioactive substance is an actinide substance.

5. The method according to claim 2, wherein the nitric acid molar concentration has a value of 4M.

6. The method according to claim 3, further comprising washing the plastics material following contact thereof with the decontaminating liquid.

7. The method according to claim 3, wherein contacting the plastics material with the decontaminating liquid further comprises:

placing the plastics material in a rotatable vessel having one or more apertures; and subjecting the plastics material to a leaching cycle comprising:

supplying the decontaminating liquid to the inside of the rotatable vessel, rotating the rotatable vessel to agitate the decontaminating liquid and mix the plastics material with the decontaminating liquid, terminating the rotation of the rotatable vessel, and discharging the decontaminating liquid from the rotatable vessel.

8. The method according to claim 4, wherein the actinide substance comprises uranium.

9. The method according to claim 7, further comprising subjecting the plastics material to a washing cycle comprising:

supplying a washing liquid to the inside of the rotatable vessel, rotating the rotatable vessel to mix the washing liquid with the plastics material, terminating rotation of the rotatable vessel, and discharging the washing liquid from the rotatable vessel.

10. The method according to claim 7, wherein, prior to placing the plastics material in the rotatable vessel, the plastics material is held in a container having one or more perforations.

11. The method according to claim 9, further comprising subjecting the plastics material to at least one further washing cycle.

12. The method according to claim 9, further comprising subjecting the plastics material to three washing cycles.

13. A composition prepared during the cleaning of plastics materials, the composition comprising:

an aqueous solution of nitric acid;

a NOx generating agent selected from the group consisting of sodium nitrite and ferrous metal;

NOx gases produced from the reaction of the NOx generating agent with the aqueous solution of nitric acid; and a plastics material contaminated with a radioactive substance, wherein the NOx gases remove at least a portion of the radioactive substance from the plastic material.

14. The composition according to claim 13, wherein the aqueous solution of nitric acid has a molar concentration having a value within a range of 3M to 5M.

15. The composition according to claim 14, wherein the molar concentration value is 4M.

* * * * *